US005980724A

United States Patent [19]

Roberts et al.

[11] Patent Number: 5,980,724

[45] Date of Patent: Nov. 9, 1999

[54] METHOD OF ELECTROCHEMICALLY PRODUCING EPOXIDES

[75] Inventors: David G. Roberts, Gibsonia; Peter C. Foller; Robert H. Tang, both of Murrysville; Yingchao Zhang, Pittsburgh, all of Pa.

[73] Assignee: PPG Industries Ohio, Inc., Cleveland, Ohio

[21] Appl. No.: 09/112,657

[22] Filed: Jul. 9, 1998

[51] Int. Cl.[6] ..... C25B 3/00; C25B 7/00

[52] U.S. Cl. ..... 205/428; 204/537; 204/539; 204/541

[58] Field of Search ..... 205/428, 455, 205/456; 204/537, 539, 541

[56] References Cited

U.S. PATENT DOCUMENTS

| | | | |
|---|---|---|---|
| 3,288,692 | 11/1966 | Le Duc | 204/80 |
| 3,351,635 | 11/1967 | Kollar | 260/348.5 |
| 3,427,235 | 2/1969 | Le Duc | 204/78 |
| 3,451,905 | 6/1969 | Krönig et al. | 204/80 |
| 3,501,388 | 3/1970 | Krönig et al. | 204/79 |

(List continued on next page.)

FOREIGN PATENT DOCUMENTS

| | | |
|---|---|---|
| 637691 | 3/1964 | Belgium . |
| 1258856 | 1/1968 | Germany . |
| 1090006 | 11/1967 | United Kingdom . |

OTHER PUBLICATIONS

Holbrook et al., Electrooxidation of Olefins at a Silver Electrode, *Journal of Catalysis* 1975, vol. 38, 1975, pp. 294–298, no month available.

Chou et al., Anodic Oxidation of Propylene on a Screen Electrode, *Chemical Engineering Science* 1980, vol. 35, pp. 1581–1590, no month available.

Van Der Eijk et al., Electrochemical Epoxidation of Olefins, *Catalysis Today* 1988, vol. 3, pp. 259–266, no month available.

Scott et al., "Pilot Scale Electrosynthesis of Alkene Oxides by Direct and Indirect Oxidation in a Sieve Plate Electrochemical Reactor", *Chemical Engineering Science* 1992, vol. 47, pp. 2957–2962, no month available.

Oduoza et al., "Aspects of the Direct Electrochemical Oxidation of Propylene", *Chem. Eng. Symp. Series* 1994, No. 127, pp. 37–48, no month available.

(List continued on next page.)

*Primary Examiner*—Kathryn Gorgos
*Assistant Examiner*—Edna Wong
*Attorney, Agent, or Firm*—Irwin M. Stein; James R. Franke

[57] ABSTRACT

Described is a method of electrochemically converting α-halohydrins, e.g., 1-chloro-2-hydroxypropane and 1,3-dichloro-2-hydroxypropane, to epoxides, e.g., propylene oxide and epichlorohydrin. An electrolytic cell is provided having (1) a catholyte compartment containing a cathode assembly comprising a cathode and a bipolar ion exchange membrane, (2) an anode compartment containing an anode assembly comprising either (a) a hydrogen consuming gas diffusion anode and a current collecting electrode or (b) a hydrogen consuming gas diffusion anode which is fixedly held between a hydraulic barrier and a current collecting electrode, and (3) at least one pair of intermediate compartments separating the catholyte and anode compartments and separated from each other by an anion exchange membrane. The following are introduced into the cell: a first aqueous conductive electrolyte solution into the catholyte compartment; hydrogen gas into the anode compartment; an aqueous solution of α-halohydrin into the first compartment of the pair of intermediate compartments; and a second aqueous conductive electrolyte solution into the second compartment of the pair of intermediate compartments. Direct current is passed through the electrolytic cell, and an aqueous solution comprising epoxide is removed from the first compartment.

18 Claims, 2 Drawing Sheets

U.S. PATENT DOCUMENTS

| | | | |
|---|---|---|---|
| 3,635,803 | 1/1972 | Binns et al. | 204/80 |
| 4,024,043 | 5/1977 | Dege et al. | 204/296 |
| 4,116,889 | 9/1978 | Chlanda et al. | 521/27 |
| 4,560,451 | 12/1985 | Nielsen | 204/79 |
| 4,634,506 | 1/1987 | Novak et al. | 204/80 |
| 4,726,887 | 2/1988 | McIntyre | 204/80 |
| 5,411,641 | 5/1995 | Trainham, III et al. | 204/59 R |
| 5,527,436 | 6/1996 | Cooker et al. | 204/428 |

OTHER PUBLICATIONS

Otsuka et al., "Simultaneous Epoxidation of 1–Hexene and Hydroxylation of Benzene During Electrolysis of Water", *Chemistry Letters* 1994, pp. 1861–1864, no month available.

Otsuka et al., Electrocatalytic Synthesis of Propylene Oxide During Water Electrolysis, *Journal of Catalysis* 1995, vol. 157, pp. 450–460, no month available.

METHOD OF ELECTROCHEMICALLY PRODUCING EPOXIDES

DESCRIPTION OF THE INVENTION

The present invention relates to a method of electrochemically producing epoxides, e.g., alkylene oxides and epihalohydrins. Particularly, the present invention relates to an electrochemical method of converting α-halohydrins to epoxides. The present invention also relates to the use of electrolytic cells having at least one pair of intermediate compartments separated from each other by an anion exchange membrane, and separated from a catholyte compartment by a bipolar ion exchange membrane and from a hydrogen gas anode compartment by either a hydraulic barrier or a hydrogen consuming gas diffusion anode.

Commercial methods of producing epoxides, such as alkylene oxides include, for example: vapor phase oxidation of alkylene, e.g., ethylene, with molecular oxygen in the presence of a silver catalyst; catalytic reaction of alkylene, e.g., propylene, with an organic hydroperoxide, as described in U.S. Pat. No. 3,351,635; and what is known in the art as the halohydrin process. The halohydrin process, e.g., chlorohydrin process, is among the most common commercial methods of producing alkylene oxide, e.g., propylene oxide. The production of propylene oxide by the chlorohydrin process typically comprises three steps, chlorohydrination, dehydrochlorination, i.e., epoxidation, and product separation.

Chlorohydrination involves the reaction of propylene with chlorine in aqueous solution to form two isomers of propylene chlorohydrin. In the dehydrochlorination step, alkali metal hydroxide, such as sodium hydroxide, or milk of lime is added to the aqueous propylene chlorohydrin solution to form an aqueous solution of propylene oxide, organic co-products and brine, e.g., an aqueous salt solution such as aqueous sodium chloride. Separation of propylene oxide and organic co-products from the brine typically involves an evaporative or distillation process. Propylene oxide is usually separated from the organic co-products by fractional distillation. The presence of halide anion, e.g., chloride anion, in the brine requires that the distillation column(s) be fabricated from expensive corrosion resistant materials, such as titanium and stainless steel. Moreover, the waste water resulting from the distillation process is typically treated prior to disposal to remove trace amounts of organic compounds.

In the most common process of manufacturing epichlorohydrin, allyl chloride is reacted with chlorine in aqueous solution to give a mixture of 1,2-dichloro-3-propanol and 1,3-dichloro-2-propanol, sometimes referred to as an isomeric mixture of glycerol chlorohydrins. This isomeric mixture is dehydrochlorinated with an alkali and the resulting epichlorohydrin separated by steam stripping. Final purification can be accomplished by distillation. As with the above described chlorohydrin process, distillation column(s) are typically fabricated from expensive corrosion resistant materials, and the distillation waste water treated prior to disposal. In addition, contact times in all steps must be carefully controlled to minimize hydrolysis of the epichlorohydrin.

The commercial methods described above can be expensive, particularly with regard to the cost of distillation equipment, utility costs, raw material costs and the required treatment of waste streams. As a result, such methods are dedicated typically to the high volume production of epoxides and can be expensive to expand.

Methods of electrochemically producing alkylene oxide, which utilize a variety of electrochemical cell configurations and feed streams have been described in, for example, U.S. Pat. Nos. 3,288,692; 3,427,235; 3,451,905; 3,501,388; 3,635,803; 4,560,451; 4,634,506; 4,726,887; and 5,527,436. The described electrochemical cell configurations include, single compartment, two compartment and bipolar stacked arrays. The described feed streams include, water, oxygen, alkali metal halide, e.g., potassium bromide, and olefin, e.g., propylene.

Because of the drawbacks of current commercial methods, alternative methods for producing epoxides, e.g., alkylene oxides such as propylene oxide, that are lower in cost with regard to capital investment for equipment, raw material costs, and costs for the treatment of waste streams are continually being sought. In accordance with an embodiment of the present invention, a method of converting α-halohydrins to epoxides, e.g., alkylene oxide, is provided, said method comprising:

(a) providing an electrolytic cell having (1) a catholyte compartment containing a cathode assembly, (2) an anode compartment containing an anode assembly, and (3) at least one pair of intermediate compartments separating said catholyte and anode compartments, said pair of intermediate compartments having a first compartment and a second compartment;

(b) introducing a first aqueous conductive electrolyte solution into said catholyte compartment;

(c) introducing hydrogen gas into said anode compartment;

(d) introducing an aqueous solution comprising α-halohydrin to said first compartment of said pair of intermediate compartments;

(e) introducing a second aqueous conductive electrolyte solution into said second compartment of said pair of intermediate compartments;

(f) passing direct current through said electrolytic cell; and (g) removing an aqueous solution comprising epoxide from said first compartment of said intermediate compartments, said cathode assembly comprising a cathode and a bipolar ion exchange membrane, said bipolar ion exchange membrane having a cation exchange side and an anion exchange side, said anode assembly comprising a hydrogen consuming gas diffusion anode and a current collecting electrode, said first compartment and said second compartment of said pair of intermediate compartments being separated from each other by an anion exchange membrane, said first compartment being defined (bounded) by the anion exchange side of said bipolar ion exchange membrane and said anion exchange membrane, said second compartment being defined (bounded) by said anion exchange membrane and said hydrogen consuming gas diffusion anode; provided that when said electrolytic cell has more than one pair of intermediate compartments, each pair of intermediate compartments is separated from its adjacent pair of intermediate compartments by an intermediate bipolar ion exchange membrane having a cation exchange side located on the side of said intermediate bipolar ion exchange membrane that faces said catholyte compartment and an anion exchange side located on the side of said intermediate bipolar ion exchange membrane that faces said anode compartment.

In accordance with another embodiment of the present invention, there is provided a method of producing epoxides, as described above, wherein the anode assembly further comprises a hydraulic barrier, the hydrogen consuming gas diffusion anode is fixedly held between the hydraulic barrier and the current collecting electrode, and the second compartment of said pair of intermediate compartments is separated from the anode compartment by the hydraulic barrier.

The features that characterize the present invention are pointed out with particularity in the claims which are annexed to and form a part of this disclosure. These and other features of the invention, its operating advantages and the specific objects obtained by its use will be more fully understood from the following detailed description and the accompanying drawings in which preferred embodiments of the invention are illustrated and described.

Other than in the operating examples, or where otherwise indicated, all numbers expressing quantities of ingredients, reaction conditions, and so forth used in the specification and claims are to be understood as modified in all instances by the term "about".

BRIEF DESCRIPTION OF THE DRAWINGS

In FIGS. 1–3, like reference numerals represent the same structural parts, the same process streams and the same conduits.

DETAILED DESCRIPTION OF THE INVENTION

Figure 1:
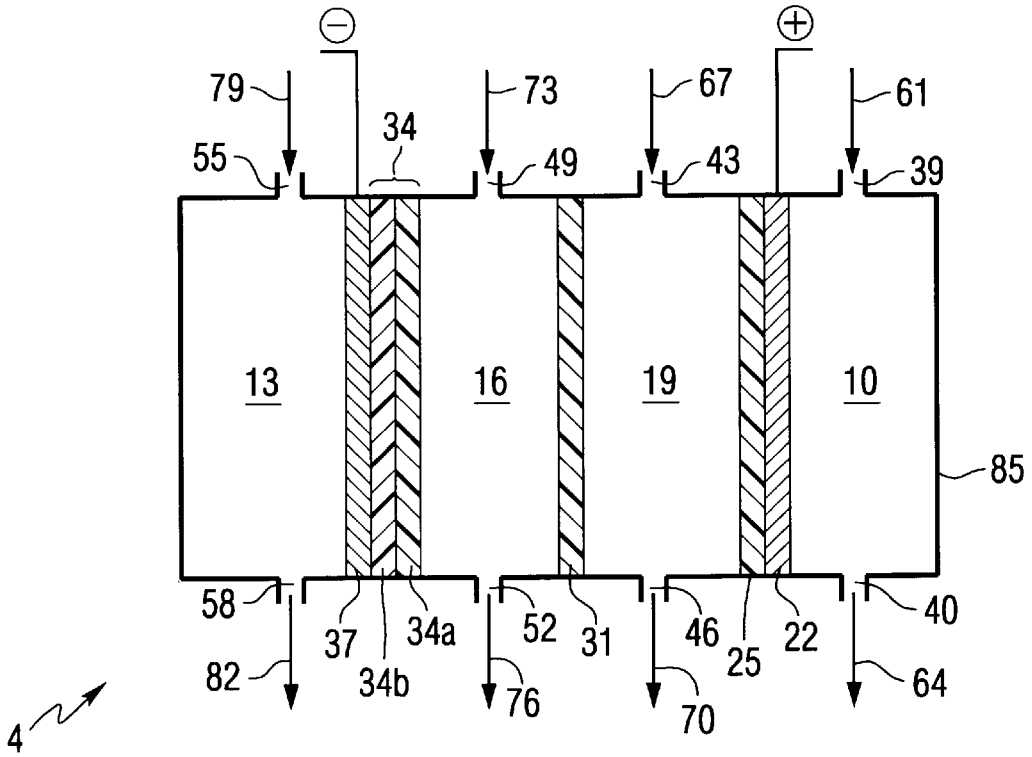
FIG. 1 is a schematic representation of an electrolytic cell useful for converting α-halohydrin to epoxide in accordance with the method of the present invention, which has one pair of intermediate compartments.
Figure 2:
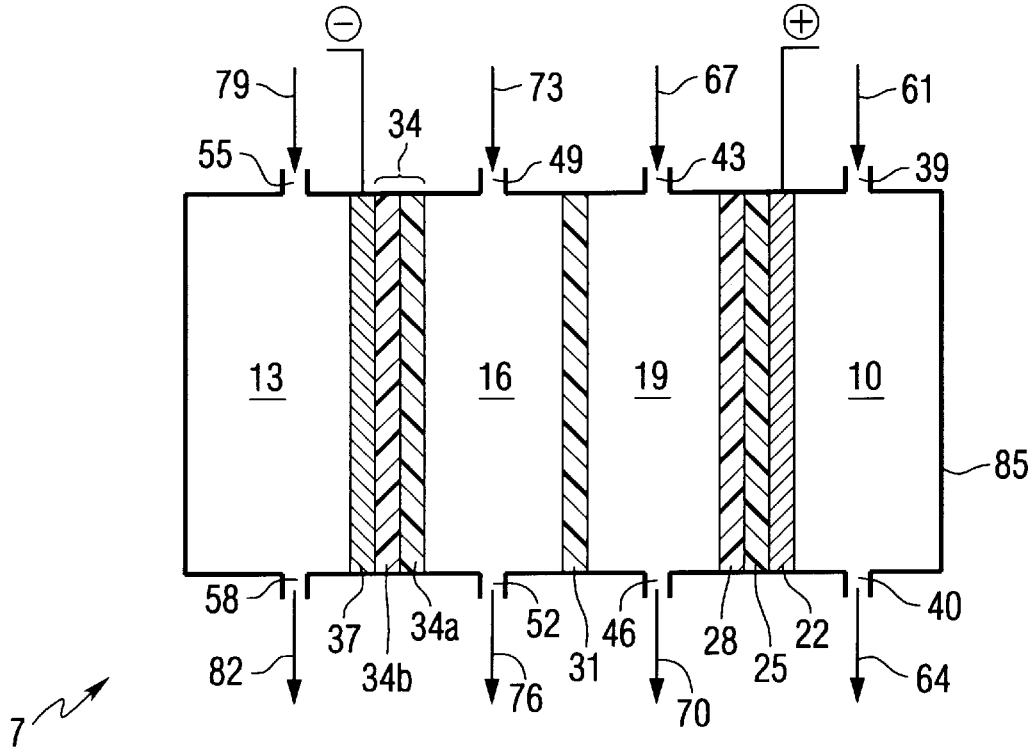
FIG. 2 is a schematic representation of an electrolytic cell similar to the electrolytic cell depicted in FIG. 1, but in which the anode assembly further comprises a hydraulic barrier.
Figure 3:
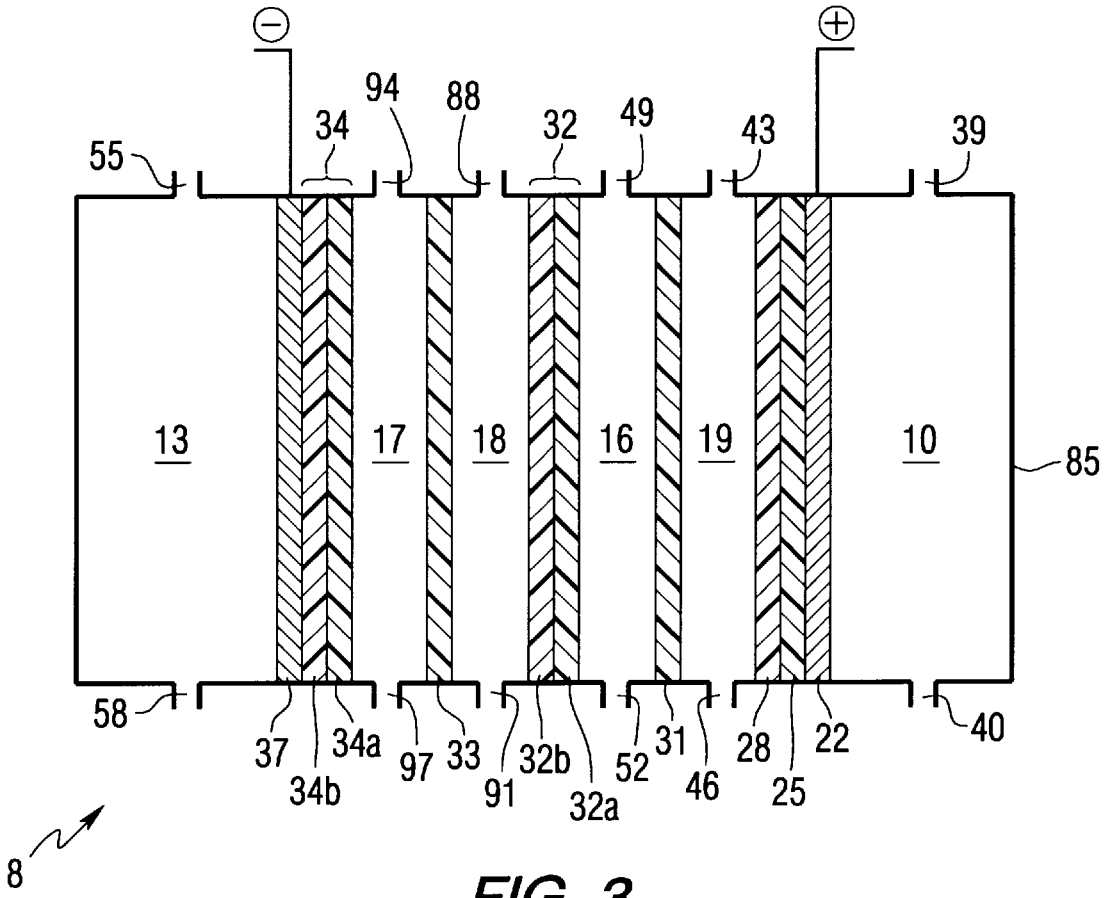
FIG. 3 is a schematic representation of an electrolytic cell similar to the electrolytic cell depicted in FIG. 2, but having two pairs of intermediate compartments.

In the practice of the present invention, electrolytic cells, such as those represented in FIGS. 1 through 3, are provided for the production of epoxides from α-halohydrins. Referring now to FIG. 2, electrolytic cell 7 comprises a housing 85 having therein a catholyte compartment 13, an anode compartment 10, and one pair of intermediate compartments comprising a first compartment 16 and a second compartment 19. The catholyte compartment 13 has an inlet 55 and an outlet 58, and contains therein a cathode assembly comprising a cathode 37 and a bipolar ion exchange membrane 34, which has a cation exchange side **34*b* and an anion exchange side 34*a*. The anode compartment 10 has an inlet 39 and an outlet 40, and contains therein an anode assembly comprising a hydrogen consuming gas diffusion anode 25 which is fixedly held between a current collecting electrode 22 and a hydraulic barrier 28. The first compartment 16 and the second compartment 19 of the pair of intermediate compartments are separated from each other by anion exchange membrane 31. Compartment 16 has an inlet 49, an outlet 52, and is separated from catholyte compartment 13 by the anion exchange side 34*a* of the bipolar ion exchange membrane 34, more particularly, the cathode assembly. Compartment 19 has an inlet 43, an outlet 46, and is separated from anode compartment 10 by hydraulic barrier 28**, more particularly, the anode assembly.

FIG. 3 depicts electrolytic cell 8, which is similar to electrolytic cell 7, but has a second pair of intermediate compartments 17 and 18. Compartment 17 is separated from compartment 18 by anion exchange membrane 33. Compartment 18 is separated from compartment 16 by intermediate bipolar ion exchange membrane 32. Intermediate bipolar ion exchange membrane 32 has a cation exchange side **32*b* which faces catholyte compartment 13, and an anion exchange side 32*a* which faces anode compartment 10. Compartment 17 and compartment 18 each have an inlet and an outlet, 94 and 97, 88 and 91**, respectively.

When the electrolytic cell used in the practice of the method of the present invention has more than one pair of intermediate compartments, each pair of intermediate compartments is separated from its adjacent pair of intermediate compartments by an intermediate bipolar ion exchange membrane. As used herein, the term "intermediate bipolar ion exchange membrane" refers to a bipolar ion exchange membrane that separates adjacent pairs of intermediate compartments and is other than the bipolar ion exchange membrane of the cathode assembly.

The electrolytic cells of FIGS. 1–3 may be assembled by any appropriate method as long as the basic structural arrangements of component parts, as depicted in FIGS. 1–3, are maintained. For example, the catholyte, anode and intermediate compartments may each be fabricated separately and then assembled by clamping or otherwise fastening the compartments together.

Housing 85 may be fabricated from any of the known conventional materials for electrolytic cells, or combinations of these known materials, that are preferably at least corrosion resistant to, and compatible with the materials comprising the process streams present within or circulated through the catholyte, anode and intermediate compartments or formed in these compartments. Examples of materials from which housing 85 may be fabricated include, but are not limited to: metal, e.g., stainless steel, titanium, and nickel; plastics, e.g., poly(vinylidene fluoride), polytetrafluoroethylene which is sold under the trademark "TEFLON", and which is commercially available from E.I. du Pont de Nemours and Company, glass filled polytetrafluoroethylene, polypropylene, poly(vinyl chloride), chlorinated poly(vinyl chloride) and high density polyethylene. Preferred materials from which housing 85 may be fabricated include, poly(vinylidene fluoride) and stainless steel.

If housing 85 is fabricated from an electrically conductive material, such as stainless steel, then appropriately positioned electrically nonconductive gaskets would typically also be present, as is known to those of ordinary skill in the art. For example, if the various compartments of the cell are prefabricated separately from stainless steel, such gaskets would typically be placed between those portions of the prefabricated compartments that would otherwise abut each other when of the electrolytic cell is assembled. Such nonconductive gaskets may be fabricated from synthetic polymeric materials, e.g., copolymers of ethylene and propylene, and fluorinated polymers.

Cathode 37 and current collecting electrode 22 may each be fabricated from any appropriate material that is at least both corrosion resistant to the environments to which they are exposed and electrically conductive. In electrolytic cells 4, 7 and 8, it is also desirable that cathode 37 and current collecting electrode 22 be substantially rigid so as to provide support for, respectively, bipolar ion exchange membrane 34, and either hydrogen consuming gas diffusion anode 25 alone or the combination of hydrogen consuming gas diffusion anode 25 and hydraulic barrier 28. Materials from which cathode 37 and current collecting electrode 22 may be fabricated include, but are not limited to: graphite; platinum; titanium coated with platinum; titanium coated with an oxide of ruthenium; nickel; stainless steel; specialty steels including high alloy steels containing nickel, chromium and molybdenum, e.g., HASTELLOY® C-2000™ alloy and HASTELLOY® C-276™ alloy from Haynes International, Inc. While current collecting electrode 22 may be fabricated from stainless steel, it is preferred to use a more corrosion resistant material such as a high alloy steel, e.g., HASTELLOY® C-2000™ alloy. Cathode 37 and current collecting electrode 22 may each comprise a material selected from the group consisting of graphite, platinum, titanium coated with platinum, titanium coated with an oxide of ruthenium, nickel, stainless steel, high alloy steel and appropriate combinations of such materials.

Preferably both cathode 37 and current collecting electrode 22 have a perforated or mesh-like configuration. A perforated or mesh-like configuration provides for increased cathode and electrode surface area, and minimizes interference with the movement of ions across the bipolar ion exchange membrane, the hydrogen consuming gas diffusion barrier and also the hydraulic barrier.

The anion exchange membrane 31 used in the practice of the present invention may be prepared from any appropriate material that is permeable to and capable of transferring anions. Typically, such anion exchange membranes are comprised of commercially available organic polymers, often thermoplastic polymers, containing weakly basic pendant polar groups. The membranes may comprise polymers based on fluorocarbons, polystyrene, polypropylene, polybutadiene, polyisoprene, polyisobutylene, polyethylene and hydrogenated styrene/butadiene block copolymers. For example, one such representative anion exchange membrane comprises polystyrene which has dialkylamino groups that have been converted into quaternary ammonium ions covalently bonded to at least some of the benzene rings of the polystyrene backbone. It is preferable that the anion exchange membrane also be physically durable and stable towards exposure to acids, in particular hydrogen halides, e.g., hydrogen chloride.

A particular example of an anion exchange membrane used in the practice of the present invention is a copolymer of styrene and divinylbenzene which contains from 4 percent (%) to 16%, typically from 6% to 8% by weight of divinylbenzene and also quaternary ammonium groups as anion carriers. Such membranes are available commercially under the trade designation RAIPORE® from RAI Research Corporation, and TOSFLEX® from Tosoh Corporation. Other suitable membranes include, but are not limited to: NEOSEPTA® membranes from Tokyuama Soda; SELEMION membranes from Asahi Glass; IONAC MA 3148, MA 3236 and MA 3457 (based on a polymer of heterogeneous polyvinyl chloride substituted with quaternary ammonium groups) membranes from Ritter-Pfaulder Corporation. Particularly preferred anion exchange membranes are NEOSEPTA® ACM and NEOSEPTA® AHA-2 membranes, available commercially from Tokuyama Soda of Japan, which are described as being comprised of a copolymer of styrene and divinylbenzene having pendent quaternary ammonium groups.

In the practice of the method of the present invention, it is preferred that hydraulic barrier 28 prevent substantially the flow of liquid and hydrogen gas between compartment 19 and anode compartment 10, while also being permeable to hydrogen cations. The hydraulic barrier 28 may be, for example, a cation exchange membrane or a microporous film.

When hydraulic barrier 28 is a cation exchange membrane, it may be fabricated of any appropriate material that is also capable of transporting cations. Examples of classes of materials from which the cation exchange membrane may be fabricated include, but are not limited to, organic polymers, in particular synthetic organic polymers, and ceramics, e.g., beta-alumina. The use of synthetic organic polymers having pendent acidic groups is preferred, many of which are commercially available or can be made according to art-recognized methods. A preferred class of synthetic organic polymers are fluoropolymers, more preferably perfluoropolymers, and in particular copolymers prepared from two or more fluoromonomers or perfluoromonomers having pendent acid groups, preferably pendent sulfonic acid groups.

When the cation exchange membrane is fabricated from fluorinated polymer(s) or copolymer(s), the pendent acid groups may include the following representative general formulas: $—CF_2CF(R)SO_3H$; and $—OCF_2CF_2CF_2SO_3H$, where R is a F, Cl, $CF_2Cl$, or a $C_1$ to $C_{10}$ perfluoroalkyl radical. The synthetic organic polymer of the cation exchange membrane may, for example, be a copolymer of ethylene and a perfluorinated monomer as represented by the following general formula, $CF_2{=}CFOCF_2CF(CF_3)OCF_2CF_2SO_3H$. These copolymers may have pendent sulfonyl fluoride groups ($—SO_2F$), rather than pendent sulfonic acid groups ($—SO_3H$). The sulfonyl fluoride groups ($—SO_2F$) can be reacted with potassium hydroxide to form $—SO_3K$ groups, which can then be reacted with an acid to form sulfonic acid groups $—SO_3H$.

Suitable cation exchange membranes comprised of copolymers of polytetrafluoroethylene and poly(vinyl ether) containing pendant sulfonic acid groups are offered by E.I. du Pont de Nemours and Company of Wilmington, Del. under the trademark "NAFION" (hereinafter referred to as NAFION®). In particular, NAFION® membranes containing pendant sulfonic acid groups include NAFION® 117, NAFION® 324 and NAFION® 417 membranes. The NAFION® 117 membrane is described as an unsupported membrane having an equivalent weight of 1100 grams per equivalent (g/eq), equivalent weight being here defined as that amount of resin required to neutralize one liter of a 1 Molar (M) sodium hydroxide solution. The NAFION® 324 and NAFION® 417 membranes are described as being supported on a fluorocarbon fabric. The NAFION® 417 membrane has an equivalent weight of 1100 g/eq. The NAFION® 324 membrane is further described as having a two-layer structure comprised of: a 125 micrometer ($\mu$m) thick membrane having an equivalent weight of 1100 g/eq; and a 25 $\mu$m thick membrane having an equivalent weight of 1500 g/eq.

While the use of cation exchange membranes based on synthetic organic polymers are preferred as hydraulic barriers, it is within the scope of the practice of the method of the present invention to use other cation-transporting membranes which are not polymeric. For example, solid state proton conducting ceramics such as beta-alumina may be used. Examples of representative solid sate proton conductors are listed in columns 6 and 7 of U.S. Pat. No. 5,411,641, which disclosure is incorporated herein by reference.

Hydraulic barrier 28 may also be a microporous film. Microporous films are known and can be described as being heterogeneous structures having a solid phase containing voids. Microporous films useful in the present invention are preferably permeable to hydrogen cations and prevent substantially the flow of liquid and hydrogen gas between compartment 19 and anode compartment 10. Suitable microporous films may be comprised of synthetic organic polymers such as polypropylene or polysulfone. An example of a commercially available microporous film useful in the practice of the method of the present invention is available under the trademark CELGARD® from Hoechst-Celanese Corp.

Bipolar ion exchange membrane 34 and intermediate bipolar ion exchange membrane 32 each comprises an anion exchange side 34*a* and 32*a*, and a cation exchange side 34*b* and 32*b*, respectively. The anion and cation exchange sides of the bipolar ion exchange membrane are typically joined or otherwise laminated together, as is known to those of ordinary skill in the art. The anion and cation exchange sides are essentially the same as the free standing anion and cation exchange membranes previously described above. A more detailed description of bipolar ion exchange membranes useful in the present invention can be found in U.S. Pat. Nos. 4,024,043 and 4,116,889, the disclosures of which are incorporated herein in their entirety. Bipolar ion exchange membranes used in the practice of the present invention can be obtained commercially from Aqualytics, Division of The Graver Company.

When saturated with water, and under the passage of a direct current through electrolytic cell 7, it is believed that water is hydrolyzed at the interface between the anion and cation exchange sides of bipolar ion exchange membrane 34. The hydrolyzed water produces hydrogen cations and hydroxide anions. The hydrogen cations are transported across cation exchange side 34*b* towards cathode compartment 13. While the hydroxide anions are transported across anion exchange side 34*a* towards anode compartment 10.

Hydrogen consuming gas diffusion anode 25 may be fabricated from any suitable material or combinations of materials which provides an electrochemically active surface upon which hydrogen gas ($H_2$) can be converted to hydrogen cation ($H^+$), through which hydrogen cations may diffuse, and which is also semihydrophobic. By semihydrophobic is meant that an aqueous liquid can penetrate the anode without flooding it, i.e., without preventing the electrochemical conversion of hydrogen gas to hydrogen cation. The electrochemical activity is typically provided by a catalytic material. Examples of suitable catalytic materials include, but are not limited to, platinum, ruthenium, osmium, rhenium, rhodium, iridium, palladium, tungsten carbide, gold, titanium, zirconium, alloys of these with non-noble metals and appropriate combinations thereof.

The hydrogen consuming gas diffusion anode 25 used in the practice of the present invention is preferably comprised of platinum, e.g., platinum supported on carbon, preferably hydrophilic carbon, or finely powdered platinum (platinum black), which has been dispersed in a polymer matrix. The polymer matrix may comprise polymers of, for example, fluorinated and perfluorinated monomers. A preferred polymer in which platinum supported on hydrophilic carbon may be dispersed is polytetrafluoroethylene. The hydrogen consuming gas diffusion anode 25 may comprise from 0.1 milligrams platinum per square centimeter of the surface area of the hydrogen consuming gas diffusion anode ($mg/cm^2$) to 15 $mg/cm^2$, preferably from 0.5 $mg/cm^2$ to 10 $mg/cm^2$, and more preferably from 0.5 $mg/cm^2$ to 6 $mg/cm^2$.

The method of the present invention may also be practiced using an electrolytic cell in which the anode assembly comprises hydrogen consuming gas diffusion anode 25 and current collecting electrode 22, and wherein compartment 19 is separated from anode compartment 10 by hydrogen consuming gas diffusion anode 25. Such a cell is represented as electrolytic cell 4 in FIG. 1. In addition to the characteristics previously recited, it is desirable that the hydrogen consuming gas diffusion anode 25 of electrolytic cell 4 also prevent substantially the flow of hydrogen gas and aqueous liquid between compartment 19 and anode compartment 10.

Within anode compartment 10 of electrolytic cells 7 and 4, the method by which the anode assembly is held together may be achieved by any appropriate means. Such methods include, but are not limited to: maintaining a higher internal pressure within compartment 16 and compartment 19 relative to anode compartment 10 and catholyte compartment 13; the method of clamping the components, 28, 25 and 22, or 25 and 22 together; providing a biasing element within, at least, each of compartments 16 and 19, e.g., separate electrically nonconductive plastic springs, not shown, can be placed within each of the intermediate compartments such that the spring placed within compartment 16 is in biased contact with bipolar ion exchange membrane 34 and anion exchange membrane 31, and the spring placed within compartment 19 is in biased contact with anion exchange membrane 31 and either hydrogen consuming gas diffusion anode 25 or hydraulic barrier 28; and combinations of these methods.

In one embodiment of the present invention hydrogen consuming gas diffusion anode 25 is hot-pressed onto one side of hydraulic barrier 28. In another embodiment of the present invention, hydrogen consuming gas diffusion anode 25 is simply placed between hydraulic barrier 28 and current collecting electrode 22 prior to assembly of the electrolytic cell. In yet another embodiment of the present invention, carbon cloth or carbon paper, not shown, is placed between hydrogen consuming gas diffusion anode 25 and current collecting electrode 22 to provide additional support to the hydrogen consuming gas diffusion anode. The carbon cloth and carbon paper are both preferably semihydrophobic, e.g., treated with TEFLON® polytetrafluoroethylene prior to use. Optionally the carbon cloth and carbon paper may also be impregnated with a catalytic material, such as platinum.

Ensuring that electrical contact exists between anode 25 and electrode 22 is important in the practice of the present invention. This is the case when the anode assembly comprises either (a) hydrogen consuming gas diffusion anode 25 fixedly held between hydraulic barrier 28 and current collecting electrode 22, or (b) hydrogen consuming gas diffusion anode 25 and current collecting electrode 22. In one embodiment of the present invention, electrical contact is maintained between hydrogen consuming gas diffusion anode 25 and current collecting electrode 22 by ensuring that a positive internal pressure difference exists between at least compartment 19 and anode compartment 10. By positive internal pressure difference is here meant that compartment 19 has an internal pressure greater than that of anode compartment 10. In this case the positive internal pressure difference value is determined by subtracting the internal pressure of anode compartment 10 from that of compartment 19. It is preferred that the internal pressure of compartment 16 be equivalent to that of compartment 19 and either equal to or greater than that of catholyte compartment 13.

The upper limit of the positive internal pressure difference between the intermediate compartments and each of catholyte compartment 13 and anode compartment 10 will depend on a number of factors including, for example, the maximum pressure that the bipolar ion exchange membrane, the anion exchange membrane, and either the hydraulic barrier or the hydrogen consuming gas diffusion anode can endure before they burst or rupture. In the practice of the present invention, the positive internal pressure difference between the intermediate compartments and each of the catholyte and anode compartments typically has a minimum value of at least 0.07 Kilograms per square centimeter ($Kg/cm^2$) (1 pound per square inch (psi)), preferably at least 0.14 $Kg/cm^2$ (2 psi), and more preferably at least 0.21 $Kg/cm^2$ (3 psi). The positive internal pressure difference between the intermediate compartments and each of the catholyte and anode compartments typically has a maximum value of less than 1.40 $Kg/cm^2$ (20 psi), preferably less than 0.70 $Kg/cm^2$ (10 psi), and more preferably less than 0.49 $Kg/cm^2$ (7 psi). In the practice of the method of the present invention, the positive internal pressure difference between the intermediate compartments and each of the catholyte and anode compartments may range between any combination of these minimum and maximum values, inclusive of the recited values.

The present invention relates to a method of electrochemically preparing epoxides from α-halohydrin. As used herein and in the claims, by the term "α-halohydrin" is meant a hydroxy or polyhydroxy functional organic species having at least one halo group covalently bonded to an $sp^3$ hybridized carbon atom, which is in a position alpha to at least one $sp^3$ hybridized carbon atom having a hydroxy group covalently bonded thereto, e.g., 1-chloro-2-hydroxypropane and 1,3-dichloro-2-hydroxypropane. Further, as used herein and in the claims, by the term "epoxide" is meant an organic compound containing one or more three membered cyclic ether groups, e.g., alkylene oxides and epihalohydrins.

The halo of the α-halohydrin is selected from the group consisting of chloro, bromo and iodo. The backbone of the α-halohydrin may be a straight or branched chain alkane having from 2 to 20 carbon atoms, preferably from 2 to 12 carbon atoms, and more preferably from 2 to 6 carbon atoms, e.g., ethane, propane, butane, isobutane, pentane, isopentane, hexane, octane, dodecane and octadecane, or a cyclic alkane having from 5 to 12 carbon atoms, e.g., cyclopentane, cyclohexane, cyclooctane and cyclododecane. Further, the α-halohydrin may have: aryl substituents, e.g., phenyl, cumenyl, mesityl, tolyl and xylyl substituents; ethylenic unsaturated substituents; and halogen, oxygen and sulfur-containing substituents, e.g., hydroxyl, thiol, carboxylic acid, ester, ether and thioether substituents.

The α-halohydrins useful in the present invention may be prepared by art-recognized methods, exemplary of which is the reaction of a hypohalous acid, e.g., hypochlorous acid, hypobromous acid or hypoiodous acid, with an olefin, e.g., ethene, propene, 1-butene, 2-butene, 1,3-butadiene, 9,10-octadecanoic acid, esters of 9,10-octadecanoic acid, 9,12-octadecadienoic acid, esters of 9,12-octadecadienoic acid, cyclopentene, vinyl cyclopentane, cyclohexene, 1,4-cyclohexadiene, vinyl cyclohexane, divinyl cyclohexane, styrene and divinyl benzene. The reaction of hypohalous acid with olefin will also typically result in the co-product formation of aqueous hydrogen halide, e.g., hydrogen chloride, hydrogen bromide or hydrogen iodide. The aqueous hydrogen halide co-product will generally be present in an amount of less than 3% by weight, for example, less than 2% by weight, based on the total weight of the aqueous solution comprising α-halohydrin.

Representative α-halohydrins useful in the present invention include, but are not limited to, 2-chloro-1-hydroxyethane, 2-bromo-1-hydroxyethane, 1-chloro-2-hydroxypropane, 1-iodo-2-hydroxypropane, 2-chloro-1-hydroxypropane, 1,3-dichloro-2-hydroxypropane, 2,3-dichloro-1-hydroxypropane, 1,3-dibromo-2-hydroxypropane, 2,3-dibromo-1-hydroxypropane, 3-chloro-1,2-dihydroxypropane, α-chlorohydroxybutane, e.g., 1-chloro-2-hydroxybutane, 1,4-dichloro-2,3-dihydroxybutane, 1-chloro-2-hydroxycyclopentane, (α-chloro-hydroxyethyl)cyclopentane, 1-chloro-2-hydroxycyclohexane, (α-chloro-hydroxyethyl)cyclohexane, bis(α-chloro-hydroxyethyl)cyclohexane, e.g., 1,2-, 1,3- and 1,4-bis(1-chloro-2-hydroxyethyl)cyclohexane, (α-chloro-hydroxyethyl)benzene and bis(α-chloro-hydroxyethyl) benzene, e.g., 1,2-, 1,3- and 1,4-bis(1-chloro-2-hydroxyethyl)benzene. In a preferred embodiment of the present invention, the α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

When the α-halohydrin contains more than three carbon atoms, its solubility in the aqueous solution circulated through catholyte compartment 13 will be reduced and the rate at which it is converted to an epoxide will also be reduced. Accordingly, to improve the solubility of the α-halohydrin, a co-solvents may also be present in the circulated aqueous solution. Examples of cosolvents suitable for use in aqueous solutions include, but are not limited to: hydroxy functional ethers of ethylene glycol, erg., butyl 2-hydroxyethyl ether and hexyl 2-hydroxyethyl ether; and hydroxy functional ethers of 1,2-dihydroxy propane, e.g., methyl 2-hydroxypropyl ether and phenyl 2-hydroxypropyl ether. If used, cosolvents are generally present in amounts of less than 10 percent by weight, e.g., less than 5 percent by weight, based on total weight of the aqueous solution circulated through catholyte compartment 13.

Representative epoxides that may be prepared in accordance with the method of the present invention include, but are not limited to, ethylene oxide, propylene oxide, 1-chloro-2,3-epoxypropane (epichlorohydrin), 1-bromo-2,3-epoxypropane (epibromohydrin), 1-hydroxy-2,3-epoxypropane, 1,2-epoxybutane, 2,3-epoxybutane, 1,2,3,4-diepoxybutane, 1,2-epoxypentane, 1,2-epoxyhexane, 1,2-epoxyoctane, 1,2,7,8-diepoxyoctane, 1,2-epoxydecane, 1,2-epoxydodecane, 6-oxabicyclo[3.1.0]hexane, 7-oxabicyclo[4.1.0]heptane, 3-epoxyethyl-7-oxabicyclo[4.1.0]heptane, 7-oxabicyclo[4.1.0]heptan-2-one, 3,4-epoxycyclohexylmethyl 3,4-epoxycyclohexanecarboxylate, exo-2,3-epoxynorborane, 9-oxabicyclo[6.1.0]nonane, 1,2,5,6-diepoxycyclooctane, 1,2-epoxycyclododecane, 1,2-epoxyethylbenzene, 2,3-(epoxypropyl)benzene, 1,2-epoxy-3-phenoxypropane and 2,3-epoxypropyl-4-methoxyphenyl ether.

The operation of electrolytic cells 4 and 7 of FIGS. 1 and 2 will now be described as they relate to preferred embodiments of the process of the present invention. A first aqueous conductive electrolyte solution is circulated through catholyte compartment 13 by forwarding the solution from a source of first aqueous conductive electrolyte solution, e.g., a temperature controlled reservoir not shown, through a suitable conduit (shown by line 79) into catholyte compartment 13 through inlet 55; withdrawing a process stream comprising the first aqueous conductive electrolyte solution from compartment 13 through outlet 58; and forwarding that process stream by a suitable conduit (shown by line 82) to the source of first electrolyte solution, e.g., a reservoir not shown.

Similarly and simultaneously with the circulation of the first aqueous conductive electrolyte solution through catholyte compartment 13, a second aqueous conductive electrolyte solution is circulated through compartment 19 by forwarding the solution from a source of second aqueous conductive electrolyte solution, e.g., a temperature controlled reservoir not shown, through a suitable conduit (shown by line 67) into compartment 19 through inlet 43; withdrawing a process stream comprising the second aqueous conductive electrolyte solution from compartment 19 through outlet 46, and forwarding that process stream by a suitable conduit (shown by line 70) to the source of second electrolyte solution, e.g., a reservoir not shown.

The first and second aqueous conductive electrolyte solutions circulated through the catholyte and second compartments respectively, are capable of conducting an electric current. It is contemplated that the first and second aqueous conductive electrolyte solutions can be circulated from the same temperature controlled reservoir, not shown.

The first and second aqueous conductive electrolyte solutions may have present therein hydrogen halide, e.g., hydrogen chloride, and/or an alkali metal halide, e.g., sodium chloride, the halide being the same as that of the α-halohydrin. The first and second aqueous conductive electrolyte solutions typically have present therein hydrogen halide in an amount of at least 1% by weight, preferably at least 5% by weight, and more preferably at least 10% by weight, based on the total weight of the aqueous conductive electrolyte solution. The hydrogen halide is also typically present in the first and second aqueous conductive electrolyte solutions in an amount less than 25% by weight, preferably less than 20% by weight, and more preferably less than 15% by weight, based on the total weight of the aqueous conductive electrolyte solution. The amount of hydrogen halide present may range between any of these amounts, inclusive of the recited amounts. In a preferred embodiment of the present invention, the first and second aqueous conductive electrolyte solutions are each comprised of an aqueous solution of hydrogen chloride.

The temperature at which the first and second aqueous conductive electrolyte solutions are maintained depends on, for example, their respective boiling points and the operating temperature limits of anion exchange membrane 31 and either hydrogen consuming gas diffusion anode 25 or hydraulic barrier 28. In the practice of the present invention, the first and second aqueous conductive electrolyte solutions are each typically maintained at a temperature of at least 25° C., preferably at least 30° C., and more preferably at least 40° C. The first and second aqueous conductive electrolyte solutions are also typically maintained at a temperature of less than 70° C., preferably less than 65° C., and more preferably less than 60° C. The temperature at which the first and second aqueous conductive electrolyte solutions are each maintained may range between any combination of these temperatures, inclusive of the recited temperatures.

Contemporaneously and in a manner similar to the circulation of the first and second aqueous conductive electrolyte solutions through their respective compartments, an aqueous solution of α-halohydrin is circulated through compartment 16 by forwarding α-halohydrin solution from a source of α-halohydrin, e.g., a temperature controlled reservoir not shown, through a suitable conduit (shown by line 73) into compartment 16 through inlet 49; withdrawing a process stream comprising epoxide and α-halohydrin from compartment 16 through outlet 52, and forwarding that process stream by a suitable conduit (shown by line 76) to the source of α-halohydrin, e.g., a reservoir not shown.

The temperature at which the aqueous solution of α-halohydrin is maintained will depend on, for example, its boiling point and the operating temperature limits of anion exchange membrane 31 and bipolar ion exchange membrane 34. In the practice of the present invention, the aqueous solution of α-halohydrin is typically maintained at a minimum temperature of at least 25° C., preferably at least 30° C., and more preferably at least 40° C. The aqueous solution of α-halohydrin is also typically maintained at a maximum temperature of less than 70° C., preferably less than 65° C., and more preferably less than 60° C. The temperature at which the aqueous solution of α-halohydrin is maintained may range between any combination of these minimum and maximum temperature values, inclusive of the recited values.

The aqueous solution comprising α-halohydrin typically contains α-halohydrin in an amount of at least 1% by weight, preferably at least 2% by weight, and more preferably at least 3% by weight, based on the total weight of the aqueous solution comprising α-halohydrin. The α-halohydrin is also typically present in an amount of not more than 30% by weight, preferably not more than 15% by weight, and more preferably not more than 10% by weight, based on the total weight of the aqueous solution comprising α-halohydrin. The amount of α-halohydrin present in the aqueous solution comprising α-halohydrin may range between any combination of these amounts, inclusive of the recited amounts.

The aqueous solution comprising α-halohydrin may optionally contain an electrical conductivity enhancing additive, e.g., a salt. Examples of suitable salts include, but are not limited to, an alkali metal halide, e.g., lithium chloride, sodium chloride, sodium bromide, sodium iodide, potassium chloride, potassium bromide and potassium iodide; and an alkaline earth metal halide, e.g., magnesium chloride and calcium chloride. If used, the salt is typically present in the aqueous solution comprising α-halohydrin in an amount of at least 0.05% by weight, preferably at least 0.1% by weight, and more preferably at least 0.5% by weight, based on the total weight of the aqueous solution comprising α-halohydrin. The salt may also be present in an amount of not more than 10% by weight, preferably not more than 5% by weight, and more preferably not more than 3% by weight, based on the total weight of the aqueous solution comprising α-halohydrin. The amount of salt present in the aqueous solution comprising α-halohydrin may range between any combination of these amounts, inclusive of the recited amounts.

Concurrently and in a manner similar to the circulation of the first and second aqueous conductive electrolyte solutions and the aqueous solution comprising (α-halohydrin through their respective compartments, hydrogen gas is circulated through anode compartment 10 by forwarding hydrogen gas from a source of hydrogen, e.g., a reservoir not shown, through a suitable conduit or transfer line (shown by line 61) into anode compartment 10 through inlet 39; withdrawing hydrogen gas from anode compartment 10 through outlet 40, and forwarding such withdrawn hydrogen gas by a suitable conduit or transfer line (shown by line 64) to the source of hydrogen, e.g., a reservoir not shown.

Other gas(es) may be present with the hydrogen gas circulated through anode compartment 10, e.g., nitrogen, as long as such other gas(es) do not adversely affect the operation of the electrolytic cell. In particular, it is preferred that the hydrogen gas-containing stream be substantially free of carbon monoxide (CO) as carbon monoxide can poison or otherwise degrade the gas diffusion hydrogen gas anode 25.

Electrolytic cells 7 and 4 may be operated at a current density of at least 0.05 Kiloamperes per square meter of electrode surface available for electrochemical reaction (Kamps/$m^2$), preferably at least 0.1 Kamps/$m^2$, and more preferably at least 0.2 Kamps/$m^2$. The current density also may be not more than 10 Kamps/$m^2$, preferably not more than 7 Kamps/$m^2$, and more preferably not more than 6 Kamps/$m^2$. In the practice of the present invention, the current density may range between any combination of these values, inclusive of the recited values. The surface area of the electrode being here calculated from its perimeter dimensions alone.

While not meaning to be bound by any theory, it is believed from the evidence at hand that the current passing through electrolytic cells 7 and 4 results in chemical and electrochemical reactions that are hereinafter described. The electrochemical and chemical reactions believed to occur within catholyte compartment 13 may be represented by the following General Scheme I:

General Scheme I $$2e^- + 2H_2O \xrightarrow{\text{Electrical Energy}} H_{2(g)} + 2OH^-$$

$$2H^+ + 2OH^- \longrightarrow 2H_2O$$

wherein $e^-$ represents an electron, $OH^-$ represents a hydroxide anion, and $H^+$ represents a hydrogen cation. The hydrogen cation $H^+$, formed from the hydrolysis of water at the interface of cation exchange side 34*b* and anion exchange side 34*a* of bipolar ion exchange membrane 34, is transported across cation exchange side 34*b* of membrane 34 and passes into catholyte compartment 13. The electrons consumed, as shown in General Scheme I, are provided by cathode 37. Hydrogen gas generated within catholyte compartment 13 is forwarded with the first aqueous conductive electrolyte process stream through a conduit (shown by line 82) to a convenient point, not shown, from where hydrogen gas may be removed. Alternatively, the hydrogen gas removed by means of the conduit represented by line 82 may be forwarded to a hydrogen gas reservoir, not shown, for recycle into anode compartment 10 by means of conduits not shown.

Within anode compartment 10, the electrochemical reaction represented by General Scheme II is believed to occur:

General Scheme II $$H_{2(g)} \xrightarrow{\text{Electrical Energy}} 2H^+ + 2e^-$$

In the case of electrolytic cell 7 of FIG. 2, hydrogen cations ($H^+$) produced within and/or on the surface of anode 25 move across hydraulic barrier 28 and pass into compartment 19. In the case of electrolytic cell 4 of FIG. 1, the hydrogen cations diffuse directly through hydrogen consuming gas diffusion anode 25 into compartment 19. The electrons generated, as shown in General Scheme II, are transferred by electrical contact from hydrogen consuming gas diffusion anode 25 to current collecting electrode 22.

Within compartment 16, the chemical reaction represented by General Scheme III is believed to occur:

General Scheme III $$OH^- + \text{alpha-halohydrin} \longrightarrow \text{epoxide} + H_2O + X^-_{(aq)}$$

wherein $X^-$ represents a halide anion. The hydroxide anion ($OH^-$), formed from the hydrolysis of water at the interface of cation exchange side 34*b* and anion exchange side 34*a* of bipolar ion exchange membrane 34, is transported across anion exchange side 34*a* into compartment 16. The halide anion $X^-$ is selectively transported across anion exchange membrane 31 into compartment 19, and therein forms aqueous hydrogen halide with the hydrogen cation transported across hydraulic barrier 28 and/or hydrogen consuming gas diffusion anode 25.

The practice of the method of the present invention includes the step of removing an aqueous solution comprising epoxide from compartment 16 and forwarding this process stream by means of conduit 76. The process stream withdrawn from compartment 16 will contain a higher amount of epoxide than the process stream entering compartment 16.

When the concentration of epoxide in the process stream circulating through compartment 16 reaches a desired level, the epoxide is recovered from that stream. Of the total molar equivalents of α-halohydrin initially present in the aqueous solution of α-halohydrin circulated through compartment 16, at least 50%, preferably at least 80%, more preferably at least 99%, and most preferably 100% of these equivalents are converted to epoxide in accordance with the practice of the method of the present invention.

Epoxide produced according to the present invention may be recovered, i.e., isolated, from the aqueous solution removed from compartment 16 by methods that are known to those of ordinary skill in the art. Such art-recognized recovery methods include, but are not limited to, steam distillation and vacuum distillation.

While a batch process has been described, a continuous process for converting the α-halohydrin to epoxide is contemplated. For example, a side stream of the circulating aqueous stream of α-halohydrin can be removed to make the process a continuous or semi-continuous process.

During operation of electrolytic cells 7 and 4, the concentration of hydrogen halide, e.g., hydrogen chloride, within the second aqueous conductive electrolyte solution in compartment 19 will increase with each pass of the circulating solution through compartment 19. The aqueous hydrogen halide process stream removed from compartment 19 will contain a higher amount of hydrogen halide than the process stream entering compartment 19 by means of conduit 67.

If the concentration of hydrogen halide within compartment 19 becomes too high, e.g., in excess of 25% by weight in the case of hydrogen chloride, based on the total weight of the second aqueous conductive electrolyte solution, the operating efficiency of the electrolytic cell 7 will likely begin to degrade. Examples of degraded operating efficiency include, higher required operating cell potentials and reduced current efficiency resulting from back migration of protons and halide anions across the various ion exchange membranes, hydraulic barrier 28 and hydrogen consuming gas diffusion anode 25.

Two further and separate embodiments of the present invention are directed to the step of maintaining the hydrogen halide concentration of the second aqueous conductive electrolyte solution circulated through compartment 19 below 25% by weight, preferably below 20% by weight, and more preferably below 15% by weight, based on the total weight of the second aqueous conductive electrolyte solution.

In the first of these two separate embodiments, the concentration of hydrogen halide within the second aqueous conductive electrolyte solution is maintained below 25% by weight by introducing into compartment 19 an aqueous stream selected from the group consisting of water, amine, aqueous alkali metal hydroxide, e.g., aqueous sodium hydroxide, and a mixture of aqueous alkali metal hydroxide and alkali metal halide, e.g., a mixture of aqueous sodium hydroxide and sodium chloride. More specifically, this aqueous reagent stream is introduced into conduit 67 at a point not shown and is forwarded along with the circulating second aqueous conductive electrolyte solution into compartment 19 through inlet 43 by means of conduit 67.

Within compartment 19, the introduced alkali metal hydroxide can combine with the hydrogen halide, e.g. hydrogen chloride, to form water and alkali halide, e.g., sodium chloride, or the introduced water will dilute the second aqueous conductive electrolyte solution. An amine, e.g., ethylene diamine (EDA), may be present within the aqueous reagent stream to combine with the hydrogen halide to form an amine hydrohalide, e.g., ethylene diamine mono- and dihydrohalide when the amine is EDA. The resultant solution exits compartment 19 through outlet 46 and is forwarded through conduit 70 to, for example, the reservoir (not shown) for the second aqueous electrolyte solution. The amount of water/reagent introduced into compartment 19 can be controlled automatically, for example, through the use of a metering device having a pH feed-back control loop, not shown. Depending on the volume of aqueous process stream added to compartment 19, the volume capacity of the reservoir, not shown, for the second aqueous electrolyte solution, may be exceeded, thereby requiring that some of the combined added aqueous stream and second aqueous electrolyte solution be removed, e.g., as a bleed stream, from the circulating solution at a convenient point through a conduit, not shown.

The amine that may be present in the aqueous reagent stream may be any suitable amine that is capable of forming an amine hydrohalide with the hydrogen halide present within compartment 19. Examples of amines suitable for use in the present invention include, but are not limited to: ammonia; monoalkyl, e.g., $C_1$–$C_{12}$ alkyl, amines, di- and tri-substituted alkyl, e.g., $C_1$–$C_{12}$ alkyl, amines, in which the alkyl groups may be the same or different, saturated or unsaturated. Examples of saturated alkyl groups include, but are not limited to, methyl, ethyl, isopropyl, n-butyl, tert-butyl, amyl and dodecyl. Examples of unsaturated alkyl groups, include, but are not limited to, allyl and methallyl. Other examples of amines are one or more amines belonging to the family of ethyleneamines, including, ethylenediamine (EDA), diethylenetriamine (DETA), triethylenetetramine (TETA), tetraethylenepentamine (TEPA), pentaethylenehexamine (PEHA), piperazine (DEDA), and 2-amino-1-ethylpiperazine; alkyl, e.g., $C_1$–$C_2$ alkyl, ethylenediamines, e.g., N-ethylethylenediamine, N,N-dimethylethylenediamine, N,N'-dimethylethylenediamine, N,N-diethylethylenediamine, N,N'-diethylethylenediamine, N,N-dimethyl-N'-ethylethylenediamine, and N,N,N',N'-tetramethylethylenediamine; propylenediamines, e.g., 1,2-propylenediamine, and 1,3-propylenediamine; alkyl, e.g., $C_1$–$C_3$ alkyl, propylenediamines, e.g., N-methyl-1,3-propylenediamine; alkanolamines, e.g., mono-, di- and tri (2-hydroxyethyl)amine; alkylamino alkanols, e.g., $C_1$–$C_6$ alkylamino $C_1$–$C_{12}$ alkanols,. e.g., 2-(ethylamino)ethanol, and 2-(diethylamino)ethanol; $C_5$–$C_7$ cycloaliphatic amines, e.g., cyclohexylamine, N-methylcyclohexylamine, and 1,4-diazobicyclo[2.2.2]octane; and aromatic amines, e.g., aniline, N-ethylaniline, and N,N-diethylaniline.

As used herein, the term "ethyleneamine" is meant to refer to one or more amines belonging to the family of ethyleneamines as previously recited. In a preferred embodiment of the present invention, the amine is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines and mixtures of such amines, as described previously.

In the second of these two separate embodiments, the concentration of hydrogen halide within the second aqueous conductive electrolyte solution is maintained below 25% by weight by: distilling the second aqueous conductive electrolyte solution removed from compartment 19 in a distillation column not shown; removing concentrated hydrogen halide distillate product and bottoms product from the distillation column; and either (a) returning the bottoms product to compartment 19 or (b) introducing an aqueous stream selected from the group consisting of water and an aqueous conductive electrolyte solution having a concentration of hydrogen halide of less than 25% by weight, preferably less than 20% by weight, and more preferably less than 15% by weight, based on the total weight of the aqueous conductive electrolyte solution, into compartment 19, by means of conduits and/or transfer lines not shown. The bottoms product may optionally be run through a heat exchanger, not shown, prior to the optional return of said bottoms product to said compartment 19.

The operation of a distillation column as described above results in reducing the volume of the second aqueous conductive electrolyte solution circulating through compartment 19. As a result, make-up water or a make-up aqueous conductive electrolyte solution having a concentration of hydrogen halide of less than 25% by weight, based on the total weight of the make-up aqueous conductive electrolyte solution, is introduced into compartment 19 to replenish the reduced volume. This can be done by introducing make-up water or make-up aqueous conductive electrolyte solution having a concentration of hydrogen halide of less than 25% by weight, based on the total weight of the make-up aqueous conductive electrolyte solution, into conduit 67 at a convenient point not shown.

Distillation columns are well known and are typically operated under conditions that result in favorable or desirable vapor-liquid equilibria. The temperature and the pressure under which a distillation column is operated can be adjusted together to shift the azeotropic point of the mixture being distilled such that a desired concentration of one or more of the components of the mixture may be retrieved. Depending on the nature of the mixture which is to be distilled, the distillation column can be of the plate type, e.g., crossflow plate or counterflow plate, or packed type.

In the practice of the present invention, when the hydrogen halide is hydrogen chloride, the hydrogen halide distillation column, not shown, is operated under the following representative conditions: a pressure of from 7.03 $Kg/cm^2$ (100 psi) to 8.44 $Kg/cm^2$ (120 psi); a feed temperature of 24° C. to 35° C.; an overhead temperature of from 32° C. to 43° C.; and a bottoms temperature of from 149° C. to 177° C. Under these conditions the concentrated hydrogen chloride distillate product exiting the distillation column has a concentration of hydrogen chloride of from 99% by weight to 99.98% by weight, based on the total weight of concentrated hydrogen chloride distillate. The bottoms product exiting the distillation column has a hydrogen chloride concentration of from 12% to 15% by weight, based on the total weight of the bottoms. The hydrogen halide distillation column is preferably of the packed type, which uses acid corrosion resistant packing materials, e.g., packing materials based on silicon carbide, and is constructed of sufficiently acid corrosion resistant materials, e.g., titanium, tantalum, stainless steel and TEFLON® polytetrafluoroethylene lined stainless steel.

While FIGS. 1–3 depict singular representations of electrolytic cells, it should be understood that the scope of the present invention is also inclusive of the utilization of a plurality of such cells. The present invention may be practiced using a plurality of cells, e.g., electrolytic cells 7 or 4, either in series or parallel. In one embodiment, a plurality of cells, not shown, e.g., cell 7, are utilized in series, wherein the outlets 58, 52, 46 and 40 of each preceding cell are in respective communication with the inlets 55, 49, 43 and 39 of each succeeding cell by means of additional conduits, not shown.

In another embodiment of the present invention, a plurality of cells, not shown, e.g., cell 7, are utilized in parallel, wherein, for example, inlet 55 and outlet 58 of catholyte compartment 13 of each cell are in common closed loop communication with a common reservoir, not shown, by means of conduits and manifolds, not shown. Accordingly, the inlets and outlets of compartment 16, compartment 19 and anode compartment 10 of each cell are in common closed loop communication with their respective reservoirs, not shown, by means of additional conduits and manifolds, not shown.

The present invention has been described with reference to specific details of particular embodiments thereof. It is not intended that such details be regarded as limitations upon the scope of the invention except insofar as and to the extent that they are included in the accompanying claims.

We claim:

1. A method of converting α-halohydrin to epoxide comprising:

(a) providing an electrolytic cell having a catholyte compartment containing a cathode assembly, an anode compartment containing an anode assembly, and at least one pair of intermediate compartments separating said catholyte and anode compartments, said pair of intermediate compartments having a first compartment and a second compartment;

(b) introducing a first aqueous conductive electrolyte solution into said catholyte compartment;

(c) introducing hydrogen gas into said anode compartment;

(d) introducing an aqueous solution comprising α-halohydrin into said first compartment of said pair of intermediate compartments;

(e) introducing a second aqueous conductive electrolyte solution into said second compartment of said pair of intermediate compartments;

(f) passing direct current through said electrolytic cell; and (g) removing an aqueous solution comprising epoxide from said first compartment of said intermediate compartments; said cathode assembly comprising a cathode and a bipolar ion exchange membrane, said bipolar ion exchange membrane having a cation exchange side and an anion exchange side, said anode assembly comprising a hydrogen consuming gas diffusion anode and a current collecting electrode, said first compartment and said second compartment of said pair of intermediate compartments being separated from each other by an anion exchange membrane, said first compartment being defined by said anion exchange side of said bipolar ion exchange membrane and said anion exchange membrane, said second compartment being defined by said anion exchange membrane and said hydrogen consuming gas diffusion anode; provided that when said electrolytic cell has more than one pair of intermediate compartments, each pair of intermediate compartments is separated from its adjacent pair of intermediate compartments by an intermediate bipolar ion exchange membrane having a cation exchange side located on the side of said intermediate bipolar ion exchange membrane that faces said catholyte compartment and an anion exchange side located on the side of said intermediate bipolar ion exchange membrane that faces said anode compartment.

2. The method of claim 1 wherein said anode assembly further comprises a hydraulic barrier, said hydrogen consuming gas diffusion anode being fixedly held between said hydraulic barrier and said current collecting electrode, and said second compartment of said pair of intermediate compartments being separated from said anode compartment by said hydraulic barrier.

3. The method of claim 2 wherein said α-halohydrin is selected from the group consisting of 2-chloro-1-hydroxyethane, 1-chloro-2-hydroxypropane, 2-chloro-1-hydroxypropane, 1,3-dichloro-2-hydroxypropane, 1,3-dibromo-2-hydroxypropane, 1-chloro-2-hydroxycyclopentane, 1-chloro-2-hydroxycyclohexane, (α-chloro-hydroxyethyl) cyclohexane, bis (α-chloro-hydroxyethyl)cyclohexane, (α-chloro-hydroxyethyl) benzene, bis(α-chloro-hydroxyethyl)benzene and mixtures thereof.

4. The method of claim 3 wherein said α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

5. The method of claim 2 wherein said first and second aqueous conductive electrolyte solutions each comprises a hydrogen halide aqueous solution having a concentration of from 1% by weight to 25% by weight hydrogen halide, based on the total weight of each of said first and second aqueous conductive electrolyte solutions introduced into said catholyte and second intermediate compartments respectively.

6. The method of claim 5 further comprising maintaining the hydrogen halide concentration of said second aqueous conductive electrolyte solution introduced into said second compartment below 25% by weight, based on the total weight of said second aqueous conductive electrolyte solution.

7. The method of claim 6 wherein the concentration of said hydrogen halide in said second aqueous conductive electrolyte solution is maintained below 25% by weight by introducing an aqueous stream selected from a member of the group consisting of water, amine, aqueous alkali metal hydroxide, and a mixture of aqueous alkali metal hydroxide and alkali metal halide into said second compartment.

8. The method of claim 7 wherein said amine is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines and mixtures of such amines.

9. The method of claim 6 wherein the concentration of said hydrogen halide of said second aqueous conductive electrolyte solution is maintained below 25% by weight by distilling second aqueous conductive electrolyte solution withdrawn from said second compartment, thereby producing a concentrated hydrogen halide distillate product and a bottoms product; and either (a) returning said bottoms product to said second compartment or (b) introducing an aqueous stream selected from the group consisting of water and an aqueous conductive electrolyte solution having a concentration of hydrogen halide of less than 25% by weight, based on the total weight of said aqueous conductive electrolyte solution, into said second compartment.

10. The method of claim 2 wherein a positive internal pressure difference of from 0.07 $Kg/cm^2$ to 1.40 $Kg/cm^2$ exists between said pair of intermediate compartments and each of said catholyte compartment and anode compartment.

11. The method of claim 2 wherein said hydrogen consuming gas diffusion anode comprises platinum supported on carbon dispersed in polytetrafluoroethylene.

12. The method of claim 11 wherein said cathode and said current collecting electrode each comprises a material selected from the group consisting of graphite, platinum, titanium coated with platinum, titanium coated with an oxide of ruthenium, nickel, stainless steel, high alloy steel and appropriate combinations of such materials.

13. The method of claim 12 wherein said anion exchange membrane and said anion exchange side of said bipolar exchange membrane each comprises a copolymer of styrene and divinylbenzene having pendent quaternary ammonium groups, said hydraulic barrier is a cation exchange membrane, and said cation exchange side of said bipolar exchange membrane and said hydraulic barrier each comprises a perfluoropolymer having pendent sulfonic acid groups.

14. A method of converting α-chlorohydrin to epoxide comprising:

(a) providing an electrolytic cell having a catholyte compartment containing a cathode assembly, an anode compartment containing an anode assembly, and at least one pair of intermediate compartments separating said catholyte and anode compartments, said pair of intermediate compartments having a first compartment and a second compartment;

(b) introducing a first aqueous conductive electrolyte solution comprising from 1% to 25% by weight hydrogen chloride, based on the total weight of said first aqueous conductive electrolyte solution, into said catholyte compartment;

(c) introducing hydrogen gas into said anode compartment;

(d) introducing an aqueous solution comprising α-chlorohydrin into said first compartment of said pair of intermediate compartments;

(e) introducing a second aqueous conductive electrolyte solution comprising from 1% to 25% by weight hydrogen chloride, based on the total weight of said second aqueous conductive electrolyte solution, into said second compartment of said pair of intermediate compartments;

(f) passing direct current through said electrolytic cell; and (g) removing an aqueous solution comprising epoxide from said first compartment of said intermediate compartments; said cathode assembly comprising a cathode and a bipolar ion exchange membrane, said bipolar ion exchange membrane having a cation exchange side and an anion exchange side, said anode assembly comprising a hydrogen consuming gas diffusion anode fixedly held between a hydraulic barrier and a current collecting electrode, said first compartment and said second compartment of said pair of intermediate compartments being separated from each other by an anion exchange membrane, said first compartment being defined by said anion exchange side of said bipolar ion exchange membrane and said anion exchange membrane, said second compartment being defined by said anion exchange membrane and said hydraulic barrier; provided that when said electrolytic cell has more than one pair of intermediate compartments, each pair of intermediate compartments is separated from its adjacent pair of intermediate compartments by an intermediate bipolar ion exchange membrane having a cation exchange side located on the side of said intermediate bipolar ion exchange membrane that faces said catholyte compartment and an anion exchange side located on the side of said intermediate bipolar ion exchange membrane that faces said anode compartment.

15. The method of claim 14 wherein said α-chlorohydrin is selected from the group consisting of 1-chloro-2-hydroxypropane, 2-chloro-1-hydroxypropane, 1,3-dichloro-2-hydroxypropane and mixtures thereof.

16. The method of claim 15 wherein said hydrogen consuming gas diffusion anode comprises platinum supported on carbon dispersed in polytetrafluoroethylene.

17. The method of claim 16 wherein said cathode and said current collecting electrode each comprises a material selected from the group consisting of graphite, platinum, titanium coated with platinum, titanium coated with an oxide of ruthenium, nickel, stainless steel, high alloy steel and appropriate combinations of such materials.

18. The method of claim 17 wherein said anion exchange membrane and said anion exchange side of said bipolar exchange membrane each comprises a copolymer of styrene and divinylbenzene having pendent quaternary ammonium groups, said hydraulic barrier is a cation exchange membrane, and said cation exchange side of said bipolar exchange membrane and said hydraulic barrier each comprises a perfluoropolymer having pendent sulfonic acid groups.

* * * * *